US005482211A

United States Patent [19]

Chao et al.

[11] Patent Number: 5,482,211

[45] Date of Patent: Jan. 9, 1996

[54] SUPERCRITICAL FLUID CLEANING APPARATUS WITHOUT PRESSURE VESSEL

[75] Inventors: Sidney C. Chao, Manhattan Beach; Thomas B. Stanford, Jr., San Pedro; Edward J. Palen, Marina Del Rey; Chris Lee, Los Angeles, all of Calif.

[73] Assignee: Hughes Aircraft Company, Los Angeles, Calif.

[21] Appl. No.: 230,656

[22] Filed: Apr. 21, 1994

[51] Int. Cl.[6] ..... B05B 1/24

[52] U.S. Cl. ..... 239/135; 239/754; 239/568

[58] Field of Search ..... 239/133, 135, 239/124, 127, 754, 227, 228, 568, 553, 553.5, 590, 590.5

[56] References Cited

U.S. PATENT DOCUMENTS 3,848,804 11/1974 Prestwich ..... 239/754
5,326,035 7/1994 Ohmi et al. ..... 239/135
5,366,154 11/1994 Thompson ..... 239/135

*Primary Examiner*—Andres Kashnikow
*Assistant Examiner*—Lesley D. Morris
*Attorney, Agent, or Firm*—M. E. Lachman; M. W. Sales; W. K. Denson-Low

[57] ABSTRACT

A nozzle for generating a supercritical fluid from a cleaning fluid. The nozzle includes a mechanism for directing the supercritical fluid onto a surface of a part to be cleaned. The nozzle comprises a body having (a) an interior portion which includes a mechanism for generating the supercritical fluid by suitable temperature and pressure increase of the cleaning fluid; (b) an inlet portion for introducing the cleaning fluid into the interior portion; (c) an outlet portion for directing the supercritical fluid generated in the interior portion onto the surface of the part to be cleaned; and (d) counteracting mechanism for resisting high pressure that is produced during the generation of the supercritical fluid so as to permit the nozzle to be maintained a suitable distance from the surface of the part to be cleaned so that the supercritical fluid impinges on the surface.

9 Claims, 4 Drawing Sheets

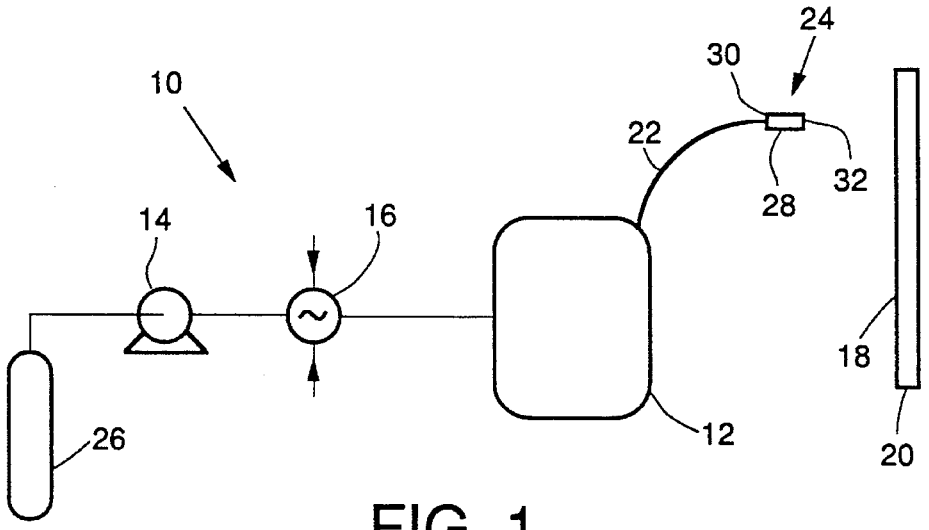
FIG. 1.
FIG. 5.
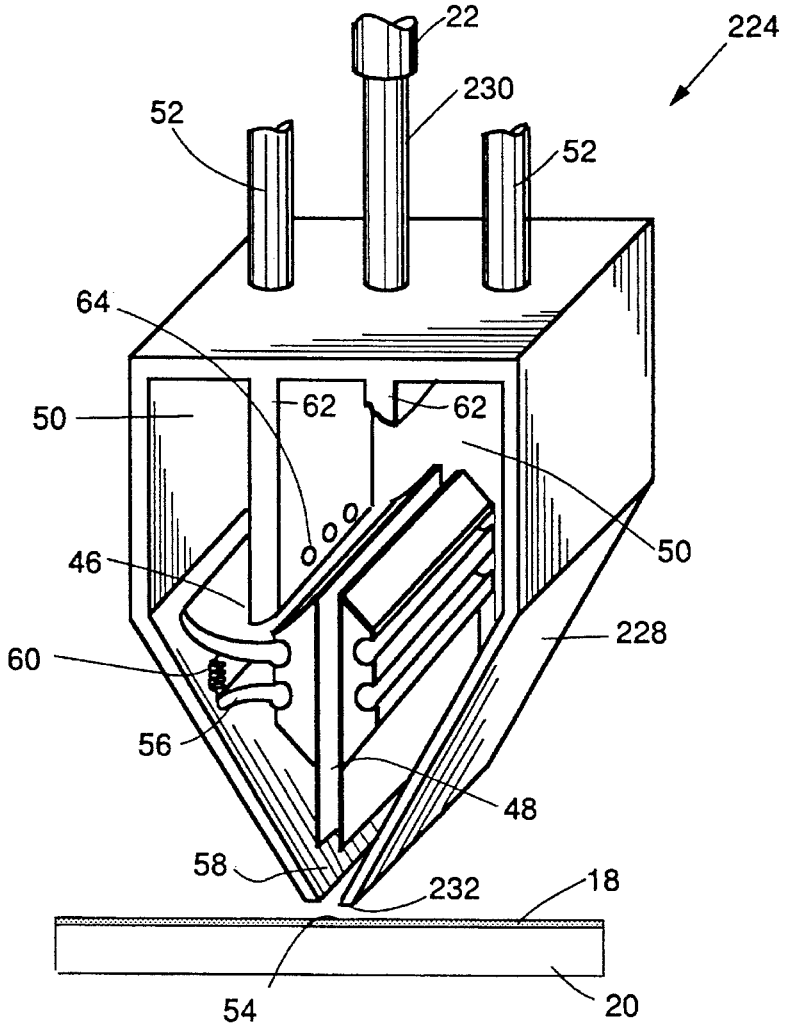

SUPERCRITICAL FLUID CLEANING APPARATUS WITHOUT PRESSURE VESSEL

BACKGROUND OF THE INVENTION

1. Field of the Invention

The present invention relates to the cleaning of substrates with supercritical fluids, and, more particularly, to a process employing fluids in the supercritical state, such as carbon dioxide, for cleaning parts without the use of a containment system or pressure vessel.

2. Description of Related Art

Currently, cleaning with a supercritical fluid is performed in pressure vessels which are capable of achieving pressures up to 5,000 psi and temperatures of up to 100° C. This technology provides the conditions required to exceed the critical points of most candidate supercritical fluids (SCFs) such as nitrogen, oxygen, argon, helium, methane, propane, carbon dioxide, and nitrous oxide. The critical points of most fluids useful for precision cleaning are all above atmospheric conditions (i.e., elevated temperature and pressure). Therefore, in order to use these fluids for cleaning, the part to be cleaned must be placed inside a vessel or containment system capable of withstanding the temperatures and pressures required to exceed the fluid's critical point.

Under supercritical conditions, the gas has the ability to dissolve contaminating species, such as organic molecules. This is to be contrasted with the use of physical removal processes, such as blowing $CO_2$ "snow" on the part to be cleaned.

Systems based on this technology typically include a pressure vessel, a fluid pump, a fluid reservoir, a separator and condenser system, and various valves, transducers, and temperature sensors. Systems of this nature are expensive and typically cost between $100,000 to $400,000 in 1992 dollars.

The pressure restriction limits the maximum size of parts that could be processed and requires a batch-type operating mode in which the process vessel is loaded, sealed, pressurized and the supercritical fluid is recirculated, depressurized and unloaded sequentially. Such batch mode processing also requires substantial periods of time, particularly in the pressurizing and depressurizing operations.

Thus, a need exists for an apparatus and method of cleaning large or irregularly-shaped parts without having to resort to high pressure vessels and batch-mode processing.

SUMMARY OF THE INVENTION

In accordance with the invention, a nozzle for generating a supercritical fluid from a cleaning fluid is provided. The nozzle includes means for directing the supercritical fluid onto a surface of a part to be cleaned. The nozzle comprises a body having (a) an interior portion which includes means for generating the supercritical fluid by suitable temperature and pressure increase of the cleaning fluid;

(b) an inlet portion for introducing the cleaning fluid into the interior portion;

(c) an outlet portion for directing the supercritical fluid generated in the interior portion onto the surface of the part to be cleaned and maintaining supercritical conditions at a given distance from said outlet portion; and (d) counteracting means for resisting high pressure that is produced during the generation of the supercritical fluid so as to permit the nozzle to be maintained a suitable distance from the surface of the part to be cleaned so that the supercritical fluid impinges on the surface.

The supercritical fluid (SCF) spray nozzle of the present invention maintains conditions above the critical point (e.g., 72.8 atmospheres and 31° C. for $CO_2$) at the nozzle outlet and the surface. The present invention permits the supercritical state of a fluid to be achieved without the use of a containment system or pressure vessel. The present invention generates the supercritical state of the cleaning fluid in a transient manner under ambient conditions. This allows the application of the supercritical fluid cleaning to parts and materials which are not conveniently contained in pressure vessels. Furthermore, for large complex assemblies, cleaning may be accomplished or repeated later in the manufacturing assembly process for specific parts even though the cleaning of the entire assembly is not required or desired. The supercritical solvent may be applied to the part in place and used to clean all surfaces, or only those surfaces which require cleaning without disassembly of the entire assembly. Applications such as large or unwieldy parts may be handled without the need to construct large, costly pressure vessels and the associated processor system. Also, point of use applications where cleaning must be performed without removing the part from fixtures, larger assemblies, manufacturing molds or other ongoing processes may be performed by the advantage of this invention.

In practicing the process of the present invention for removing contamination from a surface of a part, the cleaning fluid is introduced into the nozzle, which generates the supercritical fluid from the cleaning fluid. The supercritical fluid is directed onto the surface of the part, and the fluid and surface contamination are collected.

BRIEF DESCRIPTION OF THE DRAWINGS

FIG. 1 is a schematic view of a supercritical fluid spray system in accordance with the invention;

FIG. 5 is a perspective view of another embodiment of a nozzle employed in the system depicted in FIG. 3, using internal force coupling; and FIGS. *6a–6c* illustrate various embodiments of apparatus for recapturing supercritical cleaning fluid using the spray nozzle in conjunction with inertial blowing forces.

DESCRIPTION OF THE PREFERRED EMBODIMENTS

Figure 2:
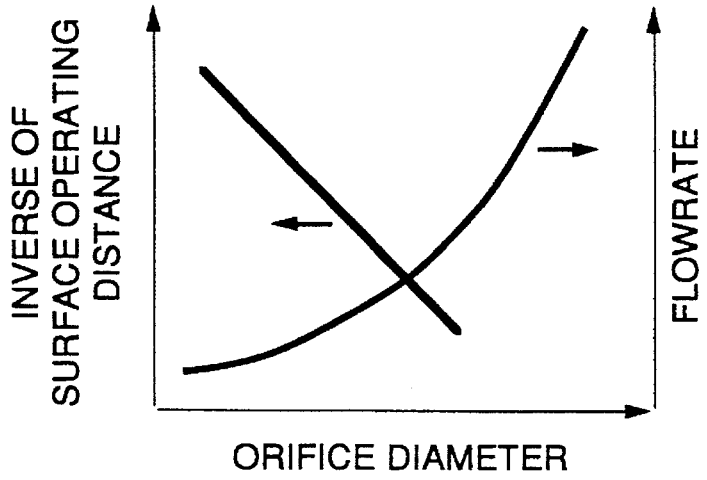
FIG. 2, on coordinates of the reciprocal of surface operating distance (left ordinate) and flowrate (right ordinate) and orifice diameter (abscissa), depicts (1) a schematic plot of maximum orifice as a function of the inverse of surface operating distance for supercritical fluid operation and (2) a schematic plot of pump/compressor flowrate as a function of orifice diameter.

The present invention is applicable to all processes involving supercritical fluids such as those employed in the SUPERSCRUB™ precision cleaning equipment (SUPERSCRUB is a trademark of Hughes Aircraft Company) for precision cleaning, general cleaning, extractions, particulate removal, degreasing, defluxing, paint removal, organic decontamination, soil remediation of toxic contaminants, activated carbon regeneration, and surface treatment additives. Example applications include spot cleaning during circuit board assembly, precision cleaning of large optical mirrors, lenses, and fixtures, precision cleaning of fuel injectors during engine assembly, and final cleaning of spacecraft assemblies/satellites; caffeine extraction from coffee beans and fragrance extraction from natural products; and precision degreasing of aircraft wings. Use of supercritical fluids in all these applications eliminates the use of ozone-depleting chlorofluorocarbons (CFCs) and smog-forming hydrocarbon solvents.

The present invention generates the conditions necessary to exceed the critical point of a fluid in a normal ambient environment. The approach used is to generate supercritical conditions at surfaces to be cleaned using a high pressure spray of the cleaning fluid. In its supercritical state, the fluid can then be used to dissolve and remove organic contaminants from the surface without the use of a pressure vessel.

The system 10 employed in the practice of the present invention is shown in FIG. 1. The cleaning fluid is contained in a pressurized reservoir 12, equipped with a compressor 14 and heating/cooling coils 16 to control fluid density. The cleaning fluid is sprayed onto the surface 18 of the part 20 to be cleaned through a high pressure hose 22. A nozzle 24 serves to direct the fluid and also to impact the fluid onto the surface XS. By proper nozzle design, the fluid pressure and temperature are increased to a value above the critical point of the fluid prior to impact on surface be. A source 26 of the supercritical cleaning fluid is used to supply the pressurized reservoir Spray nozzle designs, standoff distances, and fluid density requirements may be calculated using fluid dynamics theory. These calculations determine the parameters needed to achieve the instantaneous pressures and temperatures required for the supercritical state for $CO_2$ and other candidate fluids.

The basic design of the nozzle 24 comprises a body 28 which includes means for generating the supercritical fluid by suitable temperature and pressure increase of the cleaning fluid, an inlet portion 30 for introducing the cleaning fluid into the body of the nozzle, and an outlet portion 32 for directing the supercritical fluid onto the surface 18 of the part 20 to be cleaned.

The body of the nozzle also includes means for dealing with, or counter-acting, the high pressure that is generated during the creation of the supercritical fluid. The high pressure may be such as to prevent an operator from maintaining the nozzle 24 close enough to the surface 18 of the part 20 to be cleaned so as to take advantage of the cleaning power of the supercritical fluid. This distance may vary from design to design, but typically is on the order of less than 1 to 10 millimeters. Such counteracting means are described more fully below.

Any of the supercritical fluids well-known in the art may be employed in the practice of the invention. Examples of such supercritical cleaning fluids that may be employed to clean parts include, but are not limited to, carbon dioxide, nitrogen, oxygen, nitrous oxide ($N_2O$), methyl fluoride, argon, helium, xenon, methane, ethane, and propane, with carbon dioxide being most preferred.

Further, co-solvents and modifiers may be added as deemed appropriate. Co-solvents include organic fluids such as ethanol, methane, and kerosene that can solubilize organic molecules and inert fluids such as nitrogen and helium. In addition, any of the cleaning fluids listed above may be employed as co-solvents. The co-solvents change the solubility properties of the supercritical fluid. Modifiers include compounds such as "soaps" (molecules having a hydrophilic portion and a hydrophobic portion) to assist in solubilizing organic contaminants. The concentration of such co-solvents and/or modifiers may range from parts per billion up to 50 volume percent.

In designing suitable nozzles for use in the practice of the invention, there are two major considerations: pressure and temperature of the cleaning fluid.

It is desired to maintain a high pressure outside of the pressure vessel. This is done by employing a small diameter orifice, as discussed more fully below. Further, a high pressure is maintained by keeping the spray nozzle as close to the surface to be cleaned as possible. In a sense, in maintaining a high pressure outside of the pressure vessel, one might describe the spray as a high pressure vessel leak.

With regard to temperature of the fluid, the fluid cools upon expansion and so the fluid must be preheated prior to its emergence from the nozzle. For example, based on enthalpy considerations, in the case of $CO_2$, the pressure within the nozzle body is maintained at a pressure above the critical pressure of 1,078 pounds per square inch. Specifically, the pressure of the SCF is maintained within the range of about 1,500 to 4,000 pounds per square inch. The temperature of the SCF may or may not be above the critical temperature of 31° C. as it enters the nozzle body. The use of higher pressures enables use of a larger nozzle body and a larger operating distance of the nozzle from the surface. However, the pump to provide the requisite pressure must also be larger, which limits the useful maximum pressure.

The pressure at the surface to be cleaned ($P_n$) is a function of nozzle-to-surface separation distance (D), the inside nozzle pressure ($P_i$) and the orifice diameter (d). The relationship of these four parameters can be expressed in the following equation.

$$P_n = -K(D) + P_i$$

where K is a constant.

In a preliminary experiment, the inventors have demonstrated the generation of supercritical $CO_2$ conditions at the surface to be cleaned by using the system described in FIG. 1. The $CO_2$ was pressurized at 3,000 psi and heated at 80° C. before its emergence from the nozzle. The pressurized supercritical $CO_2$ was sprayed through a 0.4 mm inside diameter nozzle at a distance of 0.2 mm away from the surface to be cleaned. The resulting pressure and temperature at the surface were measured to be 1,450 psi and 54° C., respectively. The pressure on the surface dropped as the spray distance increased. The extent of the drop in pressure is described in the above equation.

The SCF is deliberately heated just prior to exiting from the nozzle body to ensure that it is above the critical temperature, not only as it exits from the nozzle body, but also that it remains above the critical temperature even as the pressure drops toward atmospheric pressure away from the sprayed area. Specifically, the SCF is heated to at least about 80° C.

As the SCF exits the nozzle, the temperature and pressure of the fluid drop. The extent of the drop in pressure is a function of the distance of the nozzle from the surface being cleaned.

In considering the nozzle diameter, one must take into account the distance from the nozzle to the surface to be cleaned and also the cost of the pump and non-recaptured $CO_2$. FIG. 2 depicts the balancing of operational parameters.

The pressure at the nozzle outlet is a strong function of nozzle to surface separation distance. The distance depends on the diameter of the orifice (orifi), and it appears that the maximum operating distance that the nozzle 24 can be from the surface 18 and still be effective in cleaning is about 20 orifice diameters. In the case of multiple orifi, that distance is based on the diameter of one orifice, assuming all orifi are the same dimension. The preferred operating distance is about 0.5 to 1.0 orifice diameters from the surface. Within this distance, supercritical pressure is maintained and sideways loss of SCF to the atmosphere is minimized. This is apparently true for all of the various embodiments disclosed herein.

The size of the orifice (orifi) is also important. If the orifice is too small, then the pressure drops very rapidly away from the nozzle. Some finite operating distance away from the surface is required, and that finite operating distance is difficult to achieve with orifi that are too small. On the other hand, if the orifice is too large, it is difficult to maintain pressure of a high volume of gas passing through the orifi.

Consistent with the foregoing considerations, an orifice diameter of 0.0005 inch, which provides an operating distance of about 0.0016 inch, is too small. On the other hand, an orifice diameter of 0.25 inch is too large. An orifice diameter within the range of 0.001 to 0.1 inch affords the best combination of operating distance and pressure considerations. This is apparently true for all of the embodiments disclosed herein.

As indicated above, the spray nozzle must be maintained as close to the surface as possible. Maintaining the appropriate distance is governed by the magnitude of the backward pressure reaction force on the nozzle, and is given by the equation $$\text{Force}=\text{pressure}\times\text{footplate area}.$$

Figure 3:
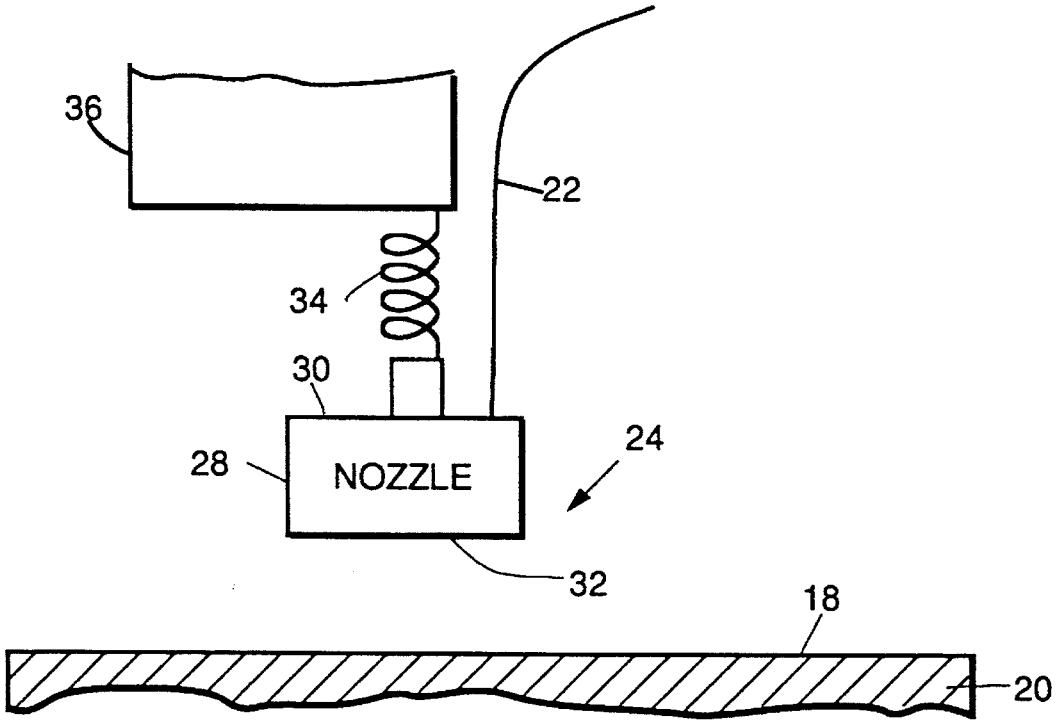
FIG. 3 is a schematic diagram of nozzle attachment to a rigid body with a spring for cleaning flat surfaces.

The reaction force varies with the orifice to surface separation distance. There are various mechanisms to counter-balance the pressure reaction force. For example, the nozzle may be attached to a rigid body with a spring for cleaning flat surfaces. FIG. 3 depicts such an arrangement. A flexible, high pressure line 22 provides a supply of supercritical $CO_2$ to the nozzle 24, which is attached by a spring 34 to a rigid body 36. The rigid body 36 is maintained a fixed distance from the surface 18 (by means not shown). In operation, the spring 34 holds the nozzle 24 on the surface 20 until the $CO_2$ pressure lifts it off. The reaction force is counter-balanced by the spring 34. It will be appreciated that this arrangement is best suited for flat surfaces.

Other examples of mechanisms to counter-balance the reaction force involve the use of the inertia of compressed gas, for example, low pressure air, or a flowing liquid to push the nozzle toward the surface to be cleaned. This arrangement permits cleaning of curved and irregular surfaces. Use of such a mechanism requires direct coupling of the pressure reaction force to a magnitude of opposite direction inertial force on the nozzle, since the pressure reaction force varies with the orifice to surface separation distance.

Figure 4:
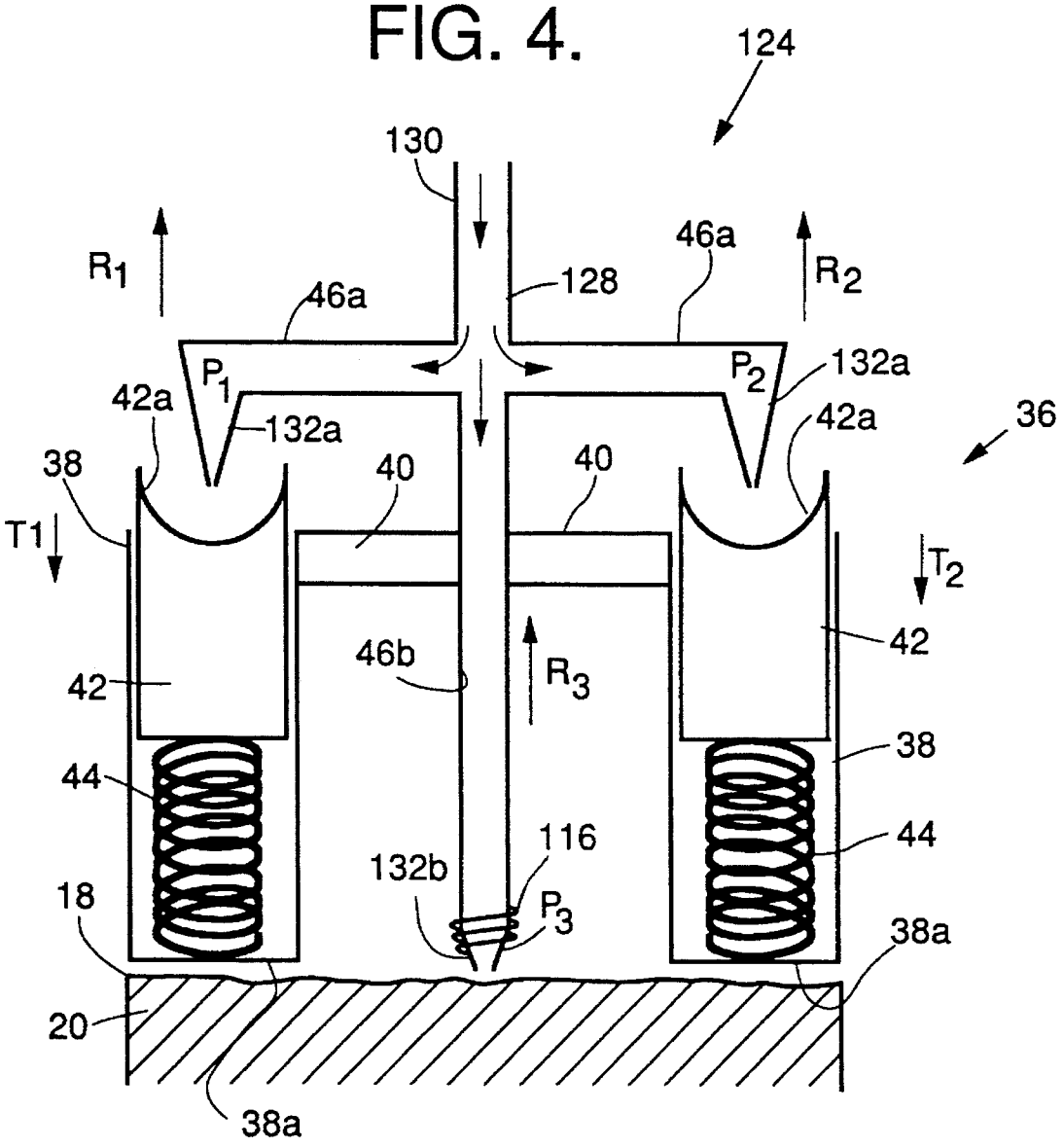
FIG. 4 is a side elevational view, in cross-section, of a first embodiment of a nozzle employed in the system depicted in FIG. 3, using external force coupling.

Two approaches to direct coupling of the pressure reaction force to a magnitude of opposite direction inertial force on the nozzle comprise external force coupling and internal force coupling and are depicted in FIGS. 4 (external coupling) and 5 (internal coupling).

FIG. 4 illustrates one embodiment of a suitable nozzle 124, employed in the practice of the present invention. The nozzle 124 comprises a body 128 which includes means for generating the supercritical fluid by suitable temperature and pressure increase of the cleaning fluid, an inlet portion 130 for introducing the cleaning fluid into the body of the nozzle, and an outlet portion **132*b* for directing the supercritical fluid onto the surface 18 of the part 20 to be cleaned. The pressure is maintained by the pump, or compressor, 44 (not shown in FIG. 4, but generically shown in FIG. 1). The temperature is maintained both by the heating coils 16 (not shown in FIG. 4, but shown in FIG. 1) and by an auxiliary heater 116 surrounding the outlet portion, or orifice, 132*b***.

The body 128 of the nozzle 124 also includes external means 36 for dealing with the high pressure that is generated during the creation of the supercritical fluid. The means 36 comprise a pair of cylinders 38, the bottoms **38*a* of which are adapted to glide on the surface 18, and attachment means 40 for attaching the cylinders to the body 128. The bottoms 38*a* are preferably coated with a non-friction material (not shown), such as poly(tetrafluoroethylene) TEFLON™ or nylon Alternatively if the orifi 132*a* and 132*b* are adapted to move relative to each other, then the cylinder bottoms 38*a* do not need to glide on the surface 18**, but may ride slightly above the surface, using mechanical or air bearings.

Each cylinder 38 is hollow and is provided with a slidable piston member 42 and a suitable spring member 44. Each piston member 42 is provided with a concave surface **42*a*, onto which fluid is directed along passages 46*a* through thrusting orifi 132*a*. The part of the fluid used for SCF cleaning continues along passage 46*b* to outlet means 132*b***.

FIG. 4 depicts the various thrust force components T and reaction force components R. The vertical displacement of the thrusting orifi 132a affects the thrust forces $T_1$ and $T_2$, but has only a small effect on $R_1$ and $R_2$. There is a large pressure drop from the thrust orifi **132*a* onto the concave surfaces 42*a*, with little pressure build-up and with mainly momentum transfer. On the other hand, there is a small pressure drop from the main orifice 132*b* onto the surface 18**, with high pressure build-up and momentum transfer.

The balance of forces on the assembled body 128 is given by $$R_3+(R_1+R_2)=T_1+T_2.$$

However, since $R_1$ and $R_2$ are very small, this equation may be approximated to $$R_3\approx T_1+T_2.$$

The design shown in FIG. 4 allows the nozzle orifice flow (P3) to be separated from the forward thrusting flow ($P_1$ and $P_2$). The advantages of separating these two flows are that low pressure gas may be used to provide the forward thrusting on the spray nozzle assembly. In addition, compressed air may be used instead of $CO_2$ for P1 and P2, thereby reducing supply gas costs. The forward thrust generated on the nozzle assembly acts against the backward pressure reaction force, enabling the nozzle orifice **132*b* to be maintained at a close distance from the surface be to be cleaned. The magnitude of the forward thrusting depends upon the rate of change of momentum of the thrusting gas when impinging onto surface 42*a*** mounted on the spray assembly. Thus, an effective high thrust gas flowrate is more important than a high gas pressure. The result is that low pressure compressed air may be used in place of $CO_2$.

FIG. 5 illustrates another embodiment of a suitable nozzle 224, employed in the practice of the present invention. In this embodiment, the supercritical fluid enters through inlet 230 from the fluid reservoir 12, shown in FIG. 1. In this embodiment, the counteracting means comprises a forward thrusting force applied on the nozzle to balance the backward pressure reaction force on the nozzle produced by the emerging stream of the supercritical fluid that impinges on surface 18. These forces are coupled directly in such a way that they counterbalance each other continuously and automatically for all surface roughnesses, curvatures and for varying nozzle to surface separation distances.

The forward thrusting force on the nozzle is achieved by using the momentum of the supercritical fluid from the fluid reservoir 12 to impart continuous impulses on pivoted aerodynamic vanes 46 in the spray nozzle. The supercritical fluid flows from the reservoir 12 to the nozzle 224 almost without friction to the wall of tube 22. Some of the supercritical fluid is directed backward by both the pivoted aerodynamic vanes 46 and part of the nozzle assembly. The aerodynamic vanes 46 and related assembly are rigidly connected to the nozzle assembly wall 48; therefore, any forward thrusting force exerted on aerodynamic vanes 46 and related assembly is transmitted to the entire supercritical fluid spray nozzle assembly. The magnitude of this forward thrusting force can be controlled by the position of aerodynamic vane 46. The further that this vane is pivoted away from the spray nozzle exit, or nozzle throat, 232, the larger this forward thrusting force will be. The supercritical fluid that is directed backwards by aerodynamic vanes 46 is collected within the nozzle assembly region 50 and directed from the nozzle along a flexible hose 52 to a supercritical fluid separator unit (not shown) for recirculating to the reservoir 12.

Supercritical fluid cleaning of the surface 18 occurs in the SCF region 54 below the nozzle throat 232. A planar geometry for the nozzle throat is the most efficient design because of its efficiency of processing a large surface area with small nozzle throat areas (which means smaller flow forces acting on the nozzle) and because pivots for aerodynamic vanes 46 and 56 are easier to construct for planar as opposed to circular or other geometries. The pressure in supercritical fluid cleaning region 58 is controlled largely by the nozzle throat-to-surface distance. As this distance is reduced, the pressure in region 58 will have a greater ability to achieve the pressure of region 50, because the gas does not expand (lower pressure) as much.

Pivoted aerodynamic vanes 56 act as a nozzle reaction force controller by exerting the reaction pressure force of region 58 directly to pivoted aerodynamic vanes 46. The pressure reaction force in region 58 acts in the opposite direction to the forward thrusting force acting on aerodynamic vanes 46 and coupled directly will balance each other out to result in no or minimal net flow force on this spray nozzle assembly. A spring 60 is used to couple aerodynamic vanes 46 with vanes 56 to dampen out force oscillations as the spray nozzle is moved across and closer or further away from various surfaces 18. This spring 60 is compressed under the force of the reaction pressure force of region 58 and the forward thrust force on aerodynamic vanes 46 and so must have a spring constant that can accommodate the sum of these forces. A similar set of aerodynamic vanes and spring is also disposed on the opposite side of the rigid mounting assembly wall 48, but is omitted from FIG. 5 for clarity.

Aerodynamic vanes 56 also act as a controller of the pressure in region 58 when the nozzle is very close to the surface 18. The SCF in region 58 has two directions that it may flow when the spray nozzle is close to the surface 18. It may either flow from the SCF region 58 sideways to atmospheric pressure or it can flow backward toward the low pressure SCF return line in region 50. It is undesirable to have sideways SCF flow out of the spray nozzle assembly because this SCF contains dissolved surface contaminant and as this fluid expands outside of the nozzle assembly to below critical conditions, the contaminant is no longer soluble and may redeposit on the surface 18. Surface recontamination is to be avoided as much as possible because a further nozzle sweep of the surface will be required to complete the surface cleaning.

As indicated above, the backward pressure reaction force is the product of the pressure at the nozzle outlet multiplied by the nozzle footplate area. In order to minimize the magnitude of this force, the nozzle footplate area should be kept as small as possible, hence the planar cone shape of the body 224. The nozzle throat's slit width must be large enough to accommodate sufficient cleaning rates. The planar cone shape aids in reducing cooling of the nozzle from SCF escaping sideways from the nozzle and expanding to atmospheric pressure by allowing it to flow away from the nozzle walls.

The forward thrusting force on aerovanes 46 depends upon the density of the SCF and its flow velocity. Hence, effort is made to increase the flow velocity of SCF impinging on aerovanes 46 within the nozzle assembly. This effort includes the use of small gap distance between aerovane 46 and the inlet SCF wall 62, directional flow jet holes labeled 64, and higher $CO_2$ recycling rates. The directional flow jet holes 64 direct the SCF onto the aerovane 46.

The magnitude of the thrusting force described above is controlled by the angle of pivoted aerovane 46, which is self-regulated by a direct coupling to aerovane 56 by the compressed spring 60. The position of aerovane 56 is governed by the difference of pressure across it and the flow rate of SCF between it and the wall of the planar cone.

Tuning of these respective forces will produce a supercritical fluid spray nozzle that is self-regulating, maintaining no net reaction force on the nozzle assembly for all nozzle to surface separation distances.

During operation of the nozzle, there are two processes that are occurring. The first process is based on inertia, and relies on the mechanical impact of the supercritical fluid, $CO_2$ "snow", for example, to remove the contaminants. The second process is based on the dissolving power of the supercritical fluid, which is improved by blowing the fluid across the surface, thereby establishing a concentration gradient.

Depending on the supercritical fluid employed, a heating means may be required just prior to the fluid exiting the spray portion of the nozzle. Such a heating means keeps the fluid above its critical point, and thus gaseous. Otherwise, if below the critical point, then the nozzle operates in the solid gas regime, which, in the case of $C_02$, means formation of "snow".

The apparatus of the present invention may be used only in the SCF cleaning mode or, by not heating the fluid just prior to exiting the spray portion of the nozzle, the apparatus may be used in both the mechanical impact ("snowblowing") mode and the SCF cleaning mode.

Figure 6A:
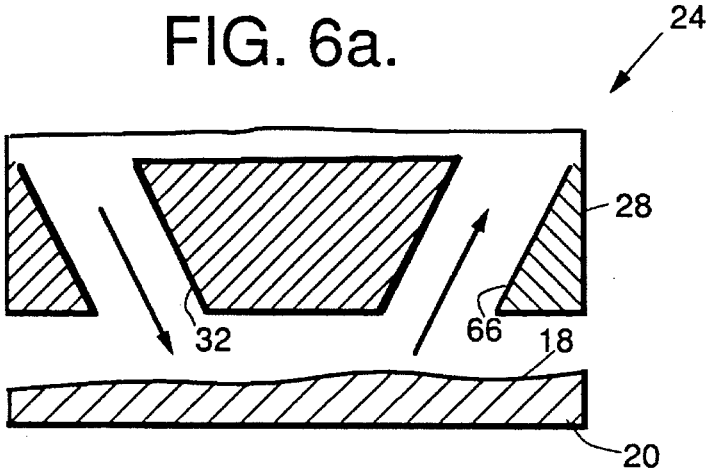
Figure 6B:
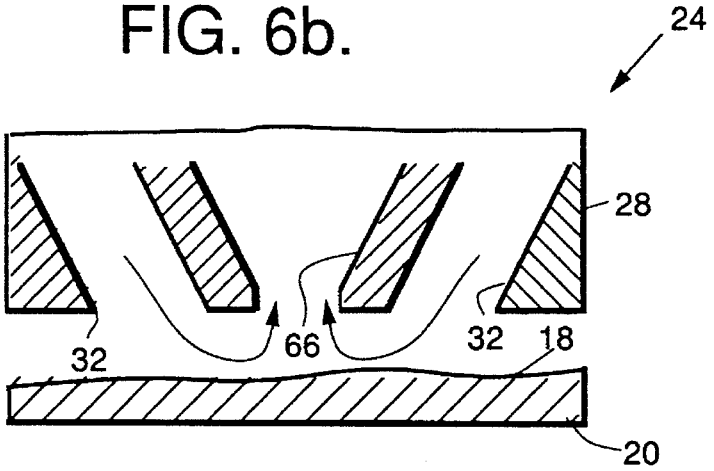
Figure 6C:
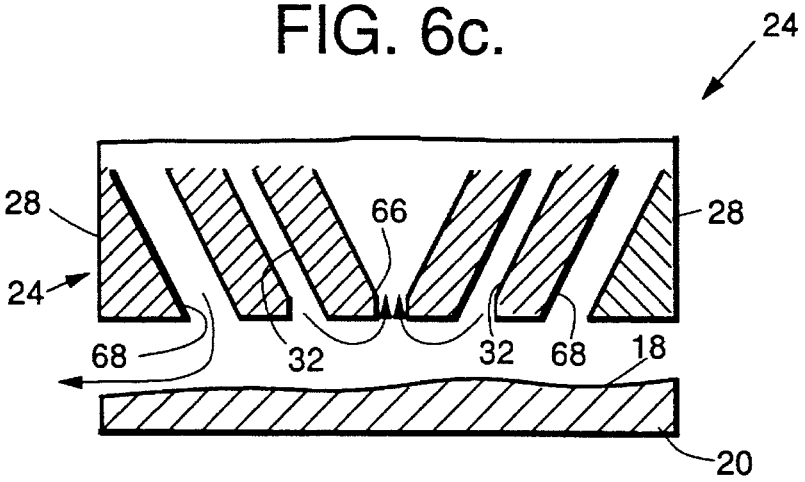

For economical reasons, it may be desirable to recapture the SCF and recycle it. This may be done by collecting material cleaned from the surface, cleaning the fluid in a separator (not shown), and recycling it. FIGS. **6*a*–6*c* depict an example of a system in which the material cleaned from the surface is collected by using inertial blowing forces. The nozzle 24 is provided with orifi 32 through which the supercritical cleaning fluid is introduced to the surface be to be cleaned, as above. These orifi 32 are arranged relative to an exit port 66, which extracts the material cleaned from the surface be along with the supercritical fluid. In FIG. 6***a*, a single orifice 32 is associated with a single exit port 66. In FIG. 6*b*, at least two orifi 32 are arranged symmetrically about a single exit port 66. As shown in FIG. 6*c*, additional orifi 68 comprise an air sheath, which provides the inertial blowing forces. The air sheath provides air under the same pressure as the $CO_2$. Using approximately the same air pressure also ensures that the $CO_2$ and material cleaned from the surface exits through the exit port.

Nozzle geometries are dictated by the nature of the surface to be cleaned. A line of small, multiple orifi may be fabricated in a single row or in a plurality of rows, with the orifi of one row offset from the orifi of an adjacent row. Further, interchangeable nozzle heads may be provided for corners, round objects, point nozzles, or special tooled geometries for specific object SCF spray cleaning.

A low friction material may be coated onto the tip of the nozzle body to provide low friction sliding action of the nozzle over the surface be without scratching the surface. Examples of suitable coating materials include poly(tetrafluoroethylene), e.g., TEFLON™, and nylon.

There are many advantages of a supercritical fluid spray nozzle of the invention:

1. No size limitations.

SCF processing can be applied to items that are too large to fit into available SCF process pressure vessels, as well as to assemblies for which disassembly is undesirable, impractical, or uneconomic. The largest SCF process pressure vessel in general use is typically a 60 liter, 12 inch diameter stainless steel chamber and represents one third of the capital cost of a SUPERSCRUB™ SCF $CO_2$ processing unit. Potential applications of the present invention include precision cleaning of large or assembled parts; degreasing of large items; paint removal from aircraft fuselage and wings; and paint removal from automobiles.

2. Mobility.

The system can be used in any situation requiring on-site SCF processing such as the inability to transport parts, the release of toxic contamination, or just the desire to have a flexible low cost SCF cleaning operation.

3. Single operator use.

The large pressures involved in SCF processing can produce large forces on the SCF spray nozzle. In such conditions, operations of supercritical fluid spray nozzles would not be safe unless these large pressure forces are counterbalanced. The present invention allows the SCF spray nozzle to experience no or minimal net force on the nozzle. These net forces are small enough that one person could easily hold and control the nozzle. The size and weight of the SCF spray nozzle are designed to be small, allowing for one person operation and highly portable and flexible cleaning operation.

4. Solvent properties.

Unlike solid $CO_2$ spray technologies such as snow and pellet which use spray inertia to blow-off particulate matter, the SCF spray will also dissolve organic contaminants from surfaces. The spray nozzle design disclosed here uses nozzle jet inertia in addition to the solubilization action of supercritical fluid to provide the desired cleaning. Solubilization rates for supercritical fluid are high due to high contaminant solubilities in most supercritical fluids and the high diffusion rates of supercritical fluids. The action of the nozzle jet inertia reduces the thickness of the stagnant boundary layer of supercritical fluid at the surface and greatly enhances this nozzle's cleaning rate.

The main advantage of the nozzle of the present invention is that it eliminates the need for a pressure vessel, and also the separator and condenser system each of which are major cost factors of such a system. Furthermore, the nozzle of the present invention permits the application of SCF cleaning to be used for remote or inaccessible cleaning applications.

Thus, there has been disclosed a nozzle and method for removing contaminants from substrates, using a supercritical fluid. It will be appreciated by those skilled in the art that various modifications and changes of an obvious nature may be made without departing from the scope of the invention, and all such modifications and changes are intended to fall within the scope of the invention, as defined by the appended claims.

What is claimed is:

1. A nozzle for generating a supercritical fluid from a cleaning fluid including means for directing said supercritical fluid onto a surface of a part to be cleaned, said nozzle comprising a body having (a) an interior portion which includes means for generating said supercritical fluid by suitable temperature and pressure increase of said cleaning fluid;

(b) an inlet portion for introducing the cleaning fluid into said interior portion;

(c) an outlet portion for directing said supercritical fluid generated in said interior portion onto said surface of said part to be cleaned; and (d) counteracting means for resisting high pressure that is produced during the generation of said supercritical fluid so as to permit said nozzle to be maintained a suitable distance from said surface of said part to be cleaned so that said supercritical fluid impinges on said surface.

2. The nozzle of claim 1 wherein said suitable distance ranges from about less than 1 to 10 millimeters.

3. The nozzle of claim 1 wherein said outlet portion includes at least one orifice, said at least one orifice having a diameter ranging from about 0.001 to 0.1 inch.

4. The nozzle of claim 1 wherein said outlet portion further includes heating means to maintain said fluid in said supercritical state.

5. The nozzle of claim 1 wherein said body comprises a main passage beginning at said inlet portion and terminating in said outlet portion and two side passages, each terminating at a thrust orifice, said nozzle further including two hollow cylinders attached to said body, each cylinder having an open end and a closed end and fitted with a slidable piston member therein, said closed end substantially coplanar with said outlet portion, each piston member separated from said closed end by a spring member attached to one end and each piston member provided with a concave surface at its other end, each said concave member operatively associated with one of said thrust orifi.

6. The nozzle of claim 1 wherein said counteracting means comprises a set of pivoted aerodynamic vanes rigidly connected to said interior of said body and interconnected by a compressed spring, a first sub-set of vanes pivoting in response to a forward thrust resulting from said cleaning fluid entering said inlet portion and a second sub-set of vanes pivoting in response to a reverse thrust, opposite to said forward thrust, resulting from said generation of said supercritical fluid.

7. The nozzle of claim 1 wherein said cleaning fluid is selected from the group consisting of carbon dioxide, nitrogen, oxygen, nitrous oxide, methyl fluoride, argon, helium, xenon, methane, ethane, and propane.

8. The nozzle of claim 7 wherein said cleaning fluid contains up to 50 volume percent of at least one co-solvent selected from the group consisting of ethanol, kerosene, carbon dioxide, nitrogen, oxygen, nitrous oxide, methyl fluoride, argon, helium, xenon, methane, ethane, and propane.

9. The nozzle of claim 7 wherein said cleaning fluid and blend thereof contains up to 50 volume percent of at least one modifier comprising a molecule having a hydrophilic portion and a hydrophobic portion.

* * * * *